US006573231B2

(12) United States Patent
Bakker et al.

(10) Patent No.: US 6,573,231 B2
(45) Date of Patent: Jun. 3, 2003

(54) DETERGENT COMPOSITIONS

(75) Inventors: Vera Johanna Bakker, Vlaardingen (NL); Daniel Pierre Berthod, Vlaardingen (NL); Christophe Michel Joyeux, Vlaardingen (NL); Duncan Howard Wright, Wirral (GB)

(73) Assignee: Unilever Home & Personal Care division of Conopco, Inc., Greenwich, CT (US)

( * ) Notice: Subject to any disclaimer, the term of this patent is extended or adjusted under 35 U.S.C. 154(b) by 66 days.

(21) Appl. No.: 09/805,263

(22) Filed: Mar. 13, 2001

(65) Prior Publication Data

US 2001/0031719 A1 Oct. 18, 2001

(30) Foreign Application Priority Data

Mar. 13, 2000 (GB) ..... 0006037

(51) Int. Cl.[7] ..... C11D 17/06; C11D 1/83

(52) U.S. Cl. ..... 510/438; 510/276; 510/351; 510/443; 510/444; 510/495; 510/498; 510/507; 510/512

(58) Field of Search ..... 510/276, 351, 510/438, 443, 444, 495, 498, 507, 512

(56) References Cited

U.S. PATENT DOCUMENTS

| | | | | |
|---|---|---|---|---|
| 4,869,843 A | | 9/1989 | Saito et al. | 252/135 |
| 5,225,100 A | * | 7/1993 | Fry et al. | 510/298 |
| 5,569,645 A | | 10/1996 | Dinniwell et al. | 510/276 |
| 5,726,142 A | * | 3/1998 | Partee et al. | 510/276 |
| 6,191,095 B1 | * | 2/2001 | Emery et al. | 510/438 |

FOREIGN PATENT DOCUMENTS

| | | |
|---|---|---|
| DE | 195 24 722 | 1/1997 |
| EP | 219 328 | 4/1987 |
| EP | 342 043 | 11/1989 |
| EP | 534 525 | 3/1993 |
| GB | 1 371 101 | 6/1981 |
| WO | 92/18596 | 10/1992 |
| WO | 96/34084 | 10/1996 |
| WO | 97/43366 | 11/1997 |
| WO | 98/04661 | 2/1998 |
| WO | 98/04662 | 2/1998 |
| WO | 98/04668 | 2/1998 |
| WO | 98/54278 | 12/1998 |
| WO | WO 98/54281 A1 * | 12/1998 |
| WO | 98/54287 | 12/1998 |
| WO | 98/54288 | 12/1998 |
| WO | 98/55574 | 12/1998 |
| WO | 00/42162 | 7/2000 |
| WO | 00/77141 | 12/2000 |

OTHER PUBLICATIONS

"High Density Detergent Composition Containing Spray–Dried Granules and Agglomerates", Anonymous, Research Disclosure, 36640, Oct. 1994.*

Derwent Abstract of JP 3 084 100—published Apr. 9, 1991.

* cited by examiner

*Primary Examiner*—Lorna M. Douyon
(74) *Attorney, Agent, or Firm*—Rimma Mitelman

(57) ABSTRACT

A particulate laundry detergent composition having a bulk density of 550 to 900 g/l comprises at least two different granular multiingredient components. A first granular component (preferably non-spray-dried) has a bulk density of 550 to 1000 g/l and has a weight ratio of a first ingredient type to a second ingredient type of r; a second granular component (preferably spray-dried) has a bulk density of from 300 to 550 g/l and has a weight ratio of the first ingredient type to the second ingredient type of r', wherein the ratio of r to r' is within the range of from 1.25:1 to 1:1.25.

23 Claims, No Drawings

DETERGENT COMPOSITIONS

TECHNICAL FIELD

The present invention relates to particulate laundry detergent compositions. The invention relates more particularly to compositions, especially zeolite-built compositions, having bulk densities within the range of from 550 to 900 g/l.

BACKGROUND

Detergent powders normally consist of a principal homogeneous granular component, normally referred to as the base powder, containing at least organic surfactant and inorganic builder, and generally containing other robust ingredients. Traditionally the base powder has been prepared by spray-drying a slurry at elevated temperature to give porous crisp granules of low bulk density, for example 300 to 500 g/l. Heat sensitive and/or less robust ingredients such as bleaches, enzymes, antifoams and certain nonionic surfactants are then admixed (postdosed) to the base powder. Postdosing generally causes an increase in bulk density but values higher than about 650 g/l are rare.

In recent years "compact" or "concentrated" powders having a higher bulk density than is attainable by spray-drying and postdosing alone have become popular. In such powders, the base powder may be prepared by densifying a spray-dried powder, or by wholly non-tower processing (mechanical mixing). Concentrated base powders typically have a bulk density of at least 700 g/l. Postdosing of additional ingredients, as in traditional powders, can bring the bulk density up to 800 g/l or above.

Concentrated (non-tower) powders have various advantages, for example: their production consumes less energy and produces less pollution than does spray-drying; there is more freedom to incorporate a wide range of ingredients because heat sensitivity is less critical; the powders can be produced to a lower moisture content, so stability of moisture-sensitive ingredients such as sodium percarbonate is better. Spray-dried powders, on the other hand, tend to have better powder properties; they may be dosed into drum-type front-loading washing machines via the dispenser drawer, whereas non-tower powders generally require a dispensing device, and they disperse and dissolve in the wash liquor more quickly and completely. They also attract considerable consumer loyalty, for example, because the dosage amount and method are familiar.

Accordingly, while concentrated powders have become popular and offer many advantages, spray-dried powders have retained a considerable consumer following. There is therefore a need for powders which combine the advantages of both types of powders without the disadvantages. The manufacturer will also wish to be able to offer a portfolio of products ranging from conventional to concentrated, and to do so using as small a number of base powder variants as possible.

On the other hand, having optimised formulation parameters with respect to detergency performance, the manufacturer will not want the overall compositions of the various products to deviate too far from the optimum.

The present inventors have accordingly proposed the use of two base granules of different bulk densities but similar compositional parameters that can be combined in a wide range of ratios, enabling the formulator either to vary bulk density at constant composition, or to vary composition at constant bulk density, in both cases whilst preserving optimum performance parameters and allowing for flexible dosing either via the washing machine dispenser or via a dispensing device.

PRIOR ART

WO 98 54288A (Unilever) discloses a particulate laundry detergent composition having a bulk density of at least 550 g/l, comprising a non-tower base powder containing surfactant and builder, and a spray-dried adjunct containing inorganic salts and optionally containing a minor amount of surfactant, wherein the non-tower base powder constitutes from 35 to 85 wt % of the total composition.

GB 1 371 101 (Unilever) discloses a detergent composition prepared by simultaneously spray-drying two different slurries, one rich in anionic surfactant and containing a lesser amount of, or no, nonionic surfactant, and the other rich in nonionic surfactant and containing a lesser amount of, or no, anionic surfactant.

WO 96 34084A (Procter & Gamble/Dinniwell) discloses a low-dosage, highly dense detergent powder comprising about 40 to 80% by weight of spray-dried detergent granules, about 20 to 60% by weight of dense detergent agglomerates, and about 1 to 20% by weight of postdosed ingredients. Preferably the weight ratio of spray-dried granules to agglomerates is 1:1 to 3:1.

EP 342 043A (Procter & Gamble) discloses detergent powders containing two different surfactant-containing granules, one of which has a defined dissolution rate.

JP 03 084 100A (Lion) discloses a high bulk density detergent powder prepared by mixing spray-dried detergent particles, containing 20 to 50% by weight of anionic surfactant and 10 to 70% by weight of zeolite, with 1 to 15% by weight of separately prepared high bulk density detergent granules.

DEFINITION OF THE INVENTION

The present invention provides a particulate laundry detergent composition having a bulk density within the range of from 550 to 900 g/l, comprising non-soap organic surfactants and detergency builders, the composition comprising at least two different granular multiingredient components:

(i) a first granular component comprising non-soap surfactant and detergency builder and having a bulk density within the range of from 550 to 1000 g/l, preferably from 600 to 1000 g/l, the first granular component having a weight ratio of a first ingredient type to a second ingredient type of r, (ii) a second granular component comprising non-soap surfactant detergency builder and having a bulk density within the range of from 300 to 550 g/l and having a weight ratio of the first ingredient type to the second ingredient type of r', wherein the ratio of r to r' is within the range of from 1.25:1 to 1:1.25.

DETAILED DESCRIPTION OF THE INVENTION

The detergent compositions are composed of at least two different multiingredient components, hereinafter referred to as base granules, each of which contains both organic non-soap surfactant and inorganic detergency builder and each of which may contain other detergent ingredients. The final composition also may, and preferably does, contain other admixed particulate or granular ingredients.

The first base granule has a bulk density of from 550 to 1000 g/l, preferably from 600 to 1000 g/l and more preferably from 700 to 950 g/l, and is preferably a mechanically mixed granule, ie is prepared by a wholly non-tower (non-spray-drying) process. Alternatively, and less preferably, it may be prepared by spray-drying and post-densification.

The second base granule has a bulk density of from 300 to 550 g/l, preferably from 350 to 500 g/l, more preferably from 400 to 500 g/l, and is preferably a spray-dried granule.

According to the invention, the two base granules are used together preferably in a weight ratio of from 0.1:1 to 5:1, more preferably from 0.1:1 to 3:1, most preferably from 0.1:1 to 2:1. As indicated above, further particulate or granular ingredients unsuitable for incorporation in a base granule, for example, bleaches, enzymes and perfume, may be subsequently admixed (postdosed), to give a final composition having a bulk density within the range of from 550 to 900 g/l, preferably from 600 to 900 g/l and more preferably from 600 to 800 g/l.

The two base granules are related compositionally to one another in that the ratios of a first ingredient type to a second ingredient type in the two base granules are similar, or, most preferably, almost the same. Accordingly, whatever the mixing ratio of the two base granules, the ratio of the first ingredient type to the second ingredient type in the resulting mixture will vary very little, and can conform to the detergency performance optimum identified by the manufacturer. The same principle may apply to other ingredient types present in both base granules, so that, for example, the ratios of the second ingredient type to a third ingredient type, or of a third ingredient type to a fourth ingredient type, in the two base granules may also be similar or the same.

As previously indicated, the composition also preferably contains additional admixed (postdosed) particulate ingredients. These may include functional ingredients such as bleaches, enzymes and foam control agents, listed in more detail below under "Detergent Ingredients", and may also contain inorganic salts. The effects of postdosing inorganic salts are to reduce the total levels of the key base granule ingredients such as surfactants and builders, because the total amount of base granules present is less, and to increase bulk density.

Accordingly, the use of the two compositionally related base granules and the possibility of postdosing enable the formulator to provide (a) a portfolio of formulations having different bulk densities but very similar amounts and proportions of key ingredients, or (b) at a given bulk density, to provide a range of related formulations having different total amounts, but similar proportions, of key ingredients.

Thus the ratios of key ingredients to one another identified as providing optimum performance and other characteristics can be preserved throughout a wide range of products suitable for different consumers, circumstances, dosage levels and methods, and wash habits. The two matched base granules provide building blocks for a large and flexible product portfolio.

The r to r' ratio is within the range of from 1.25:1 to 1:1.25, preferably from 1.2:1 to 1:1.2, more preferably from 1.1:1 to 1:1.1, and most preferably from 1.05:1 to 1:1.05. Ideally the r to r' ratio is as close as possible to 1:1.

The ingredient types to which these conditions apply may be any classes of ingredient that may conveniently be incorporated in multiingredient granular components. The ingredient types are preferably selected from total non-soap surfactant, non-soap anionic surfactant, nonionic surfactant, inorganic detergency builder, total detergency builder, and antiredeposition agent.

Preferably, the first ingredient type is selected from non-soap anionic surfactant and total non-soap surfactant, and the second ingredient type is selected from nonionic surfactant, inorganic detergency builder, total detergency builder, and antiredeposition agent.

According to a first preferred embodiment of the invention, the first ingredient type is non-soap anionic surfactant and the second ingredient type is nonionic surfactant.

Thus, a first preferred embodiment of the present invention is a particulate laundry detergent composition comprising anionic and nonionic non-soap organic surfactants and one or more inorganic detergency builders, and comprising at least two different granular multiingredient components, characterised in that it comprises (i) a first granular component containing non-soap anionic surfactant, nonionic surfactant and inorganic detergency builder and having a bulk density within the range of from 550 to 1000 g/l, preferably from 600 to 1000 g/l, and having a weight ratio of non-soap anionic surfactant to nonionic surfactant of $r_1$, (ii) a second granular component containing non-soap anionic surfactant and nonionic surfactant and inorganic detergency builder and having a bulk density within the range of from 300 to 550 g/l and having a weight ratio of non-soap anionic surfactant to nonionic surfactant of $r_2$, wherein the ratio of $r_1$ to $r_2$ is within the range of from 1.25:1 to 1:1.25, preferably from 1.2:1 to 1:1.2, more preferably from 1.1:1 to 1:1.1, and most preferably from 1.05:1 to 1:1.05.

According to the second preferred embodiment of the invention, the first ingredient type is total non-soap surfactant and the second ingredient type is inorganic detergency builder.

Thus, a second preferred embodiment of the present invention is a particulate laundry detergent composition comprising one or more organic surfactants and one or more inorganic detergency builders, and comprising at least two different granular multiingredient components, which comprises (i) a first granular component containing organic non-soap surfactant and inorganic detergency builder having a bulk density within the range of from 550 to 1000 g/l, preferably from 600 to 1000 g/l, and having a weight ratio of total non-soap surfactant to total inorganic detergency builder of $r_3$, (ii) a second granular component containing organic non-soap surfactant and inorganic detergency builder having a bulk density within the range of from 300 to 550 g/l and having a weight ratio of total non-soap surfactant to total inorganic detergency builder of $r_4$, wherein the ratio of $r_3$ to $r_4$ is within the range of from 1.25:1 to 1:1.25, preferably from 1.2:1 to 1:1.2, more preferably from 1.1:1 to 1:1.1, and most preferably from 1.05:1 to 1:1.05.

Especially preferred compositions of the invention may fall within both preferred embodiments of the invention, that is to say, the ratio of $r_1$ to $r_2$ and the ratio of $r_3$ to $r_4$ may both fall within the defined range.

Additionally, the ratio of the ratios of builder to antiredeposition agent, for example sodium carboxymethyl cellulose, in the two base granules may also advantageously fall within the defined range. The same principle may be applied to other key ingredients where it is convenient to include them in both base granules.

Preferably the two base granules contain the same non-soap anionic surfactant or surfactants. Preferred surfactants are $C_8$–$C_{15}$ alkylbenzene sulphonates, $C_8$–$C_{20}$ primary alcohol sulphates, and combinations thereof. More details about possible anionic surfactants are given below under "Detergent ingredients".

Preferably the two base granules contain the same nonionic surfactant or surfactants. Preferred nonionic surfactants are $C_8$–$C_{20}$ aliphatic alcohols ethoxylated with an average of from 2 to 15 moles of ethylene oxide per mole of alcohol. More details about possible nonionic surfactants are given below under "Detergent ingredients".

More preferably the two base granules contain the same anionic surfactant or surfactants, and the same nonionic surfactant or surfactants. The surfactant system is then the same in the two bases with respect both to anionic to nonionic ratio and to the surfactant materials themselves.

Additional surfactants, for example, cationic surfactants and/or zwitterionic surfactants, may be present. If present in both base granules, these materials may also comply with the ratio requirements given previously, if desired. However, it may be preferred to incorporate such supplementary surfactants in only one of the two base granules, or to postdose them in the form of suitable adjuncts.

Soap may be present in either or both of the base granules. Preferably the two granules contain the same inorganic detergency builder. The builder is preferably selected from alkali metal aluminosilicates, sodium tripolyphosphate and combinations thereof. The preferred builder is crystalline sodium aluminosilicate (zeolite). The most preferred builder is zeolite MAP (zeolite P having a silicon to aluminium ratio not exceeding 1.33) as disclosed in EP 384 070B (Unilever). Another preferred builder is layered sodium silicate available as SKS-6 from Clariant GmbH, Germany. More details about possible builders are given below under "Detergent ingredients".

Organic co-builders such as polycarboxylate polymers and alkali metal citrates may be present in either or both of the base granules.

Most preferably the two base granules contain the same non-soap anionic and nonionic surfactants and the same inorganic detergency builder.

The First Base Granule

The first base granule may suitably comprise from 10 to 40 wt % of organic non-soap surfactant, from 20 to 50 wt % of inorganic builder (preferably zeolite, more preferably zeolite 4A and/or zeolite MAP), from 5 to 45 wt % (in total) of other salts, and optionally minor ingredients to 100 wt %.

More preferably, the first base granule comprises from 10 to 35 wt % of anionic sulphonate or sulphate surfactant, from 5 to 20 wt % of ethoxylated nonionic surfactant, from 30 to 45 wt % of zeolite MAP, from 5 to 30 wt % (in total) of salts, preferably selected from sodium carbonate, sodium citrate and sodium sulphate, and optionally minor ingredients to 100 wt %.

The optional ingredients may be any suitable for incorporation into a non-tower base powder, and may, for example, be selected from fatty acid, fatty acid soap, polycarboxylate polymer, fluorescers and antiredeposition agents.

Preparation of the First Base Granule

The first base granule may be prepared by any process suitable for the production of granules of high bulk density. Preferably the granules are prepared by a non-tower (non-spray-drying) process, but, less preferably, they may be prepared by post-tower densification of spray-dried granules.

In a preferred non-tower process, solid ingredients are granulated with a liquid binder in a high-speed mixer, and the resulting granules may then be transferred to a moderate-speed mixer. Preferred processes are described and claimed, for example, in EP 340 013A, EP 367 339A, EP 390 251A and EP 420 317A (Unilever).

These processes can be used to prepare base powders having bulk densities of, for example, 700 to 900 g/l. It has not generally proved possible to prepare base powders having bulk densities below 700 g/l using these processes.

According to one especially preferred embodiment of the invention, the process described and claimed in WO 00/77147A (Unilever) may be used to prepare a base powder having a bulk density below 700 g/l, for example, from 600 to 700 g/l.

This process comprises the steps of:

(i) mixing and agglomerating a liquid binder with a solid starting material in a high-speed mixer;

(ii) mixing the material from step (i) in a moderate- or low-speed mixer;

(iii) feeding the material from step (ii) and a liquid binder into a gas fluidisation granulator and further agglomerating, and (iv) optionally, drying and/or cooling.

The Second Base Granule

The second base granule may suitably comprise:

from 5 to 30 wt % of organic non-soap surfactant, from 10 to 50 wt % of inorganic builder, preferably zeolite and more preferably zeolite 4A and/or zeolite MAP, from 10 to 60 wt % of other salts and polymer, and optionally minor ingredients to 100 wt %, all percentages being based on the second base granule.

The second base granule may further comprise sodium silicate, generally incorporated in solution form. The sodium silicate may, for example, be present in an amount of from 0.5 to 15 wt %, preferably from 1 to 10 wt %.

As previously indicated organic cobuilders such as polycarboxylate polymers may also be present.

More preferably, the second base granule comprises:

from 4 to 25 wt % of anionic sulphonate or sulphate surfactant, from 1 to 15 wt % of ethoxylated nonionic surfactant, from 10 to 45 wt % of zeolite MAP and/or zeolite 4A, from 1 to 10 wt % of acrylic or acrylic/maleic polymer, from 0.5 to 10 wt % of sodium silicate, from 15 to 55 wt % of other salts, and optionally minor ingredients to 100 wt %.

The other salts may include sodium sulphate, which may be incorporated in the first or second base granule, or in both, and/or may be postdosed. In formulations in which the amount of sodium sulphate is not to exceed a certain level, any sodium sulphate present is preferably incorporated in the second base granule.

The second base granule may contain optional minor ingredients suitable for incorporation into a spray-dried base powder. These may, for example, be selected from fatty acid, fatty acid soap, fluorescers and antiredeposition agents.

Preparation of the Second Base Granule

The second base granule may be prepared by conventional slurry making and spray-drying methods, well known to the skilled detergent powder formulator.

Where ethoxylated nonionic surfactant is to be present in the second base granule, it may be advantageous if all or a part of this ingredient is admixed with the spray-dried granule instead of incorporated via the slurry.

The Detergent Composition

As indicated above, the particulate laundry detergent composition of the invention contains the first (higher-bulk-density) base granule and the second (lower-bulk-density) base granule, preferably in a ratio of from 0.1:1 to 5:1, more preferably from 0.1:1 to 5:1, more preferably from 0.1:1 to 3:1, most preferably from 0.1:1 to 2:1.

The detergent composition may suitably comprise:

(i) from 8 to 60 wt %, preferably from 15 to 45 wt %, of the first base granule, (ii) from 5 to 70 wt %, preferably from 10 to 60 wt %, of the second base granule, (iii) optionally other admixed detergent ingredients to 100 wt %.

The other admixed detergent ingredients may suitably be selected from surfactant granules, bleach ingredients, antifoams, fluorescers, antiredeposition agents, soil release agents, dye transfer inhibiting agents, fabric conditioning agents, enzymes, perfumes, inorganic and organic salts, and combinations thereof.

As previously indicated, postdosed salts are preferably present when it is desired to reduce the total levels of the key base granule ingredients such as surfactants and builders, because the total amount of base granules present is less, and/or to increase bulk density.

The final composition has a bulk density of from 550 to 900 g/l, preferably from 600 to 900 g/l and more preferably from 600 to 800 g/l.

Detergent Ingredients

As previously indicated, detergent compositions of the invention contain detergent-active compounds and detergency builders, and may optionally contain bleaching components and other active ingredients to enhance performance and properties.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising anion (for example, compounds in which $R_1$ is a $C_8$–$C_{22}$ alkyl group, preferably a $C_8C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The list of surfactants is not intended to be exhaustive and the use any surfactant suitable for incorporation in particulate laundry detergent compositions falls within the scope of the present invention.

The detergent compositions of the invention also contain one or more detergency builders. The total amount of detergency builder in the compositions will suitably range from 5 to 80 wt %, preferably from 10 to 60 wt %.

Preferred builders are alkali metal aluminosilicates, more especially crystalline alkali metal aluminosilicates (zeolites), preferably in sodium salt form.

Zeolite builders may suitably be present in a total amount of from 5 to 60 wt %, preferably from 10 to 50 wt %.

The zeolites may be supplemented by other inorganic builders, for example, amorphous aluminosilicates, or layered silicates such as SKS-6 ex Clariant.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Alternatively, the compositions of the invention may contain phosphate builders, for example, sodium tripolyphosphate.

These lists of builders are not intended to be exhaustive. Especially preferred organic builders are citrates, suitably used in amounts of from 1 to 30 wt %, preferably from 2 to 15 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Detergent compositions according to the invention may also suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %.

As previously indicated, sodium silicate may also be present. The amount of sodium silicate may suitably range from 0.1 to 5 wt %. Sodium silicate, as previously indicated, is preferably introduced via the second base granule.

Powder flow may be improved by the incorporation of a small amount of a powder structurant. Examples of powder structurants, some of which may play other roles in the formulation as previously indicated, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; fluorescers; inorganic salts such as sodium sulphate; enzymes (proteases, lipases, amylases, cellulases); dyes; coloured speckles; perfumes; and fabric conditioning compounds. This list is not intended to be exhaustive.

EXAMPLES

The invention is further illustrated by the following non-limiting Examples, in which parts and percentages are by weight unless otherwise stated. The following abbreviations are used for ingredients used in the Examples (* denotes Trade Mark):

| | |
|---|---|
| LAS | Linear alkylbenzene sulphonate |
| Nonionic 7EO | $C_{12-15}$ alcohol ethoxylated with an average of 7 moles of ethylene oxide per mole |
| Zeolite MAP | Zeolite MAP (Si:Al ratio about 1) (Doucil* A24 ex Crosfield) |
| Copolymer | Acrylic/maleic copolymer, Na salt (Sokalan* CP5 ex BASF) |
| SCMC | Sodium carboxymethyl cellulose |
| CaEDTMP | Calcium salt of ethylenediamine tetramethylene phosphonic acid (Dequest* 2047 ex Monsanto) |
| TAED | Tetraacetyl ethylenediamine |
| HEDP | Sodium salt of 1-hydroxyethane-1,1-diphosphonic acid (Dequest* 2016D ex Monsanto) |

Example 1

Base Powders

Non-tower base powder B1 was prepared as follows:

(i) mixing and granulating solid starting materials consisting of zeolite MAP, light soda ash, sodium carboxymethylcellulose (SCMC) with "liquid binder" (LAS acid, nonionic surfactant, fatty acid/soap—see below) in a Lödige Recycler* (CB 30) high-speed mixer;

(ii) transferring the material from the Recycler to a Lödige Ploughshare* (KM 300) moderate-speed mixer;

(iii) transferring the material from the Ploughshare to a Vometec* fluid bed operating as a gas fluidisation granulator, adding further "liquid binder" and agglomerating; and (iv) finally drying/cooling the product in the fluid bed.

The "liquid binder" used in steps (i) and (iii) was a structured blend comprising the anionic surfactant, nonionic surfactant and soap components of the base powder. The blend temperature in the loop was controlled by a heat-exchanger. The neutralising agent was a sodium hydroxide solution.

Spray-dried base powder S1 was prepared by a conventional slurry-making and spray-drying process.

The formulations and powder properties of the base powders were as shown in the table below.

| | B1 | S1 |
|---|---|---|
| NaLAS | 15.58 | 9.18 |
| Nonionic 7EO | 12.12 | 7.15 |
| Soap (stearic) | 1.76 | 2.10 |
| Zeolite MAP (100%) | 40.67 | 24.00 |
| Copolymer | — | 3.00 |
| Sodium carbonate | 13.70 | 15.50 |
| Sodium silicate (100%) | — | 1.90 |
| SCMC (100%) | 0.57 | 0.38 |
| Sodium sulphate | — | 27.03 |
| Granular Na sulphate | 7.08 | — |
| Moisture and salts | 8.52 | 9.76 |
| Total | 100.00 | 100.00 |
| Bulk density (g/l) | 800 | 450 |
| $r_1$ | 1.285 | |
| $r_2$ | | 1.284 |
| $r_3$ | 0.681 | |
| $r_4$ | | 0.680 |
| $r_1$:$r_2$ | 1.001 | |
| $r_3$:$r_4$ | 1.001 | |

Particle size distributions (Rosin-Rammler)

| | | |
|---|---|---|
| RRd [micrometer] | 663 | 410 |
| RRn [–] | 2.4 | 2.1 |
| Fines <180 micron [%] | 3.3 | 15.8 |
| Coarse >1400 micron [%] | 4.0 | 0.7 |

Examples 2 to 9

Particulate Detergent Compositions

Fully formulated detergent compositions were prepared by mixing the non-tower base powder B1 with the spray-dried base powder S1, and postdosing further ingredients. All exhibited excellent detergency, powder properties and bleach stability.

| Example | 2 | 3 | 4 | 5 |
|---|---|---|---|---|
| Weight ratio B1:Sl | 16.94:57 | 20:52 | 32:32 | 42.5:14 |
| Bulk density (g/l) | 615 | 650 | 720 | 820 |
| NaLAS | 7.87 | 7.89 | 7.93 | 7.91 |
| Nonionic 7EO | 6.13 | 6.14 | 6.17 | 6.15 |
| Soap | 1.57 | 1.51 | 1.28 | 1.06 |
| Zeolite MAP (100%) | 20.57 | 20.61 | 20.69 | 20.64 |
| Copolymer | 1.71 | 1.56 | 0.96 | 0.42 |
| Na carbonate | 11.15 | 10.80 | 9.34 | 7.99 |
| Na silicate (100%) | 1.08 | 0.99 | 0.61 | 0.27 |
| SCMC (100%) | 0.46 | 0.46 | 0.44 | 0.43 |
| Na sulphate | 15.41 | 14.06 | 8.65 | 3.78 |
| Granular Na sulphate | 1.20 | 1.42 | 2.27 | 3.01 |
| Moisture and salts | 6.79 | 6.57 | 5.67 | 4.84 |
| Subtotal for base powders | 73.94 | 72.00 | 64.00 | 56.50 |
| Total non-soap surfactants | 14.00 | 14.03 | 14.09 | 14.06 |
| Postdosed ingredients | | | | |
| Na perborate tetrahydrate | 13.50 | — | — | — |
| Na percarbonate | — | 10.50 | 10.50 | 10.50 |
| TAED (83%) | 1.50 | 1.50 | 1.50 | 1.50 |
| Antifoam granule | 1.15 | 1.15 | 1.15 | 1.15 |
| Fluorescer adjunct (15%) | 0.80 | 0.80 | 0.80 | 0.80 |
| CaEDTMP (34%) | 0.60 | 0.60 | 0.60 | 0.60 |
| Na carbonate (dense) | 0.93 | 5.87 | 13.87 | 21.37 |
| Carbonate/silicate granules | 4.50 | 4.50 | 4.50 | 4.50 |
| Enzyme (protease) | 0.18 | 0.18 | 0.18 | 0.18 |
| Na citrate 2aq | 2.00 | 2.00 | 2.00 | 2.00 |
| HEDP (85%) | 0.60 | 0.60 | 0.60 | 0.60 |
| Perfume | 0.30 | 0.30 | 0.30 | 0.30 |
| Total | 100.00 | 100.00 | 100.00 | 100.00 |

| Example | 6 | 7 |
|---|---|---|
| Weight ratio B1:S1 | 26:48 | 34.1:34.0 |
| Bulk density (g/l) | 650 | 720 |
| LAS | 8.46 | 8.43 |
| Nonionic 7EO | 6.58 | 6.56 |
| Soap | 1.53 | 1.36 |
| Zeolite MAP (100%) | 22.09 | 22.03 |
| Copolymer | 1.44 | 1.02 |
| Na carbonate | 11.00 | 9.94 |
| Na silicate (100%) | 0.91 | 0.65 |
| SCMC (100%) | 0.48 | 0.47 |
| Na sulphate | 12.97 | 9.19 |
| Granular Na sulphate | 1.84 | 2.41 |
| Moisture and salts | 6.69 | 6.03 |
| Subtotal for base powders | 74.00 | 68.10 |
| Total non-soap surfactants | 15.04 | 15.00 |
| Postdosed ingredients | | |
| Na percarbonate | 15.36 | 15.36 |
| TAED (83%) | 2.50 | 2.50 |
| Antifoam granule | 1.15 | 1.15 |
| Fluorescer adjunct (15%) | 0.80 | 0.80 |
| CaEDTMP (34%) | 0.60 | 0.60 |
| Na disilicate granules | 1.50 | — |
| Carbonate/silicate granules | — | 5.50 |
| Enzymes (protease, lipase, amylase) | 1.02 | 1.02 |
| Soil release polymer | 0.12 | 0.12 |
| Polyvinyl pyrrolidone | 0.08 | 0.08 |
| Na citrate 2aq | 2.00 | 2.00 |
| Na carbonate (dense) | — | 0.90 |
| HEDP | 0.60 | 0.60 |
| Perfume | 0.27 | 0.27 |
| Total | 100.00 | 100.00 |

| Example | 8 | 9 |
|---|---|---|
| Weight ratio Bl:Sl | 13.0/50.0 | 22.0/36.0 |
| Bulk density (g/l) | 650 | 720 |
| LAS | 6.62 | 6.73 |
| Nonionic 7EO | 5.15 | 5.24 |
| Soap | 1.34 | 1.19 |
| Zeolite MAP (100%) | 17.29 | 17.59 |
| Copolymer | 1.50 | 1.08 |
| Na carbonate | 9.53 | 8.60 |
| Na silicate (100%) | 0.95 | 0.68 |
| SCMC (100%) | 0.39 | 0.38 |
| Na sulphate | 13.52 | 9.73 |
| Granular Na sulphate | 0.92 | 1.56 |
| Moisture and salts | 5.80 | 5.22 |
| Subtotal for base powders | 63.00 | 58.00 |
| Total non-soap surfactants | 11.77 | 11.97 |
| Na percarbonate | 8.00 | 8.00 |
| Antifoam granule | 1.00 | 1.00 |
| Fluorescer adjunct (15%) | 0.45 | 0.45 |
| CaEDTMP (34%) | 0.40 | 0.40 |
| Na carbonate (dense) | 20.73 | 25.73 |
| Carbonate/silicate granules | 3.50 | 3.50 |
| Enzyme (protease) | 0.16 | 0.16 |
| Na citrate 2aq | 2.00 | 2.00 |
| HEDP | 0.50 | 0.50 |
| Perfume | 0.26 | 0.26 |
| Total | 100.00 | 100.00 |

Example 10

Base Powders

Further spray-dried powders S2 to S4 having a range of bulk densities were prepared by slurry-making and spray-drying. As indicated, the nonionic surfactant was in part incorporated via the slurry and in part post-added (sprayed on).

| | S2 | S3 | S4 |
|---|---|---|---|
| NaLAS | 9.18 | 9.17 | 9.16 |
| Nonionic 7EO (via slurry) | 3.65 | 1.70 | — |
| Soap | 2.23 | 2.23 | 2.23 |
| Zeolite MAP (100%) | 24.00 | 23.98 | 23.95 |
| Copolymer | 1.90 | 1.90 | 1.90 |
| Sodium carbonate | 15.50 | 15.48 | 15.47 |
| Sodium silicate (100%) | 5.71 | 5.71 | 5.70 |
| SCMC (68%) | 0.56 | 0.56 | 0.56 |
| Sodium sulphate | 24.32 | 24.30 | 24.27 |
| Moisture and salts | 9.45 | 9.47 | 9.26 |
| Nonionic 7EO (post-added) | 3.50 | 5.50 | 7.50 |
| Total | 100.00 | 100.00 | 100.00 |
| Bulk Density (g/l) | 435 | 400 | 350 |

Example 11

Base Powders

Non-tower base powder B2 was prepared by the method described in Example 1, and spray-dried base powder S5 was prepared by a conventional slurry-making and spray-drying process, a part (3.5%) of the nonionic surfactant being post-added (sprayed on).

| | B2 | S5 |
|---|---|---|
| NaLAS | 15.42 | 9.17 |
| Nonionic 7E0 | 12.00 | 7.20 |
| Soap | 1.74 | 2.23 |
| Zeolite MAP (100%) | 39.40 | 23.99 |
| Copolymer | — | 2.97 |
| Sodium carbonate | 12.93 | 18.30 |
| Sodium silicate (100%) | — | 1.94 |
| SCMC (68%) | 0.83 | 0.56 |
| Sodium sulphate | — | 26.98 |
| Granular Na sulphate | 9.68 | — |
| Moisture and salts | 8.00 | 6.66 |
| Total | 100.00 | 100.00 |
| Bulk density (g/liter) | 750–800 | 400–450 |
| $r_1$ | 1.285 | |
| $r_2$ | | 1.274 |
| $r_3$ | 0.696 | |
| $r_4$ | | 0.682 |
| $r_1$:$r_2$ | 1.009:1 | |
| $r_3$:$r_4$ | 1.02:1 | |

Examples 12 to 15

Particulate Detergent Compositions

A range of fully formulated detergent compositions was prepared by mixing the non-tower base powder B2 with the spray-dried base powder S5 and postdosing further ingredients.

| Example | 12 | 13 | 14 | 15 |
|---|---|---|---|---|
| Weight ratio B2:S5 | 28.25: 43.75 | 39.10: 42.50 | 22.50: 48.50 | 9.00: 58.75 |
| Bulk density (g/l) | 650 | 650 | 615 | 615 |
| NaLAS | 8.37 | 9.93 | 7.92 | 6.78 |
| Nonionic 7EO | 6.54 | 7.73 | 6.19 | 5.31 |
| Soap | 1.47 | 1.63 | 1.47 | 1.47 |
| Zeolite MAP (100%) | 21.63 | 25.61 | 20.50 | 17.64 |
| Copolymer | 1.30 | 1.28 | 1.44 | 1.74 |
| Na carbonate | 11.66 | 11.64 | 11.78 | 11.91 |
| Na silicate (100%) | 0.85 | 0.81 | 0.94 | 1.14 |
| SCMC (68%) | 0.48 | 0.56 | 0.46 | 0.40 |
| Na sulphate | 11.80 | 11.49 | 13.09 | 15.85 |
| Granular Na sulphate | 2.73 | 3.78 | 2.18 | 0.87 |
| Moisture and salts | 5.17 | 7.14 | 5.03 | 4.64 |
| Subtotal for base powders | 72.00 | 81.60 | 71.00 | 67.75 |

Postdosed Ingredients

| Example | 12 | 13 | 14 | 15 |
|---|---|---|---|---|
| Na perborate $4H_2O$ | — | — | 14.80 | 8.00 |
| Na percarbonate | 15.00 | — | — | — |
| TAED (83%) | 2.71 | — | 2.72 | — |
| CaEDTMP (34%) | 0.72 | 0.72 | 0.54 | 0.38 |
| Antifoam granule | 1.22 | 1.45 | 1.15 | 0.98 |
| Fluorescer adjunct (15%) | 0.80 | — | 0.65 | 0.44 |
| Soil release polymer (63%) | 0.19 | 0.19 | — | — |
| PVP granule (95%) | 0.08 | 0.23 | 0.08 | — |
| HEDP (85%) | 0.40 | 0.40 | 0.30 | 0.20 |
| Na carbonate (dense) | — | 5.53 | 4.04 | 10.90 |
| Na bicarbonate | — | 3.00 | — | — |

-continued

| Example | 12 | 13 | 14 | 15 |
|---|---|---|---|---|
| Carbonate/silicate cogranules | 3.60 | 3.60 | 2.70 | — |
| Na citrate 2aq | 2.00 | 2.00 | 1.50 | 1.00 |
| Sodium sulphate | — | — | — | 9.92 |
| Protease granule[1] | 0.44 | 0.44 | 0.22 | 0.16 |
| Lipase granule[2] | 0.03 | 0.03 | — | — |
| Amylase granule[3] | 0.31 | 0.31 | — | — |
| Cellulase granule[4] | 0.20 | 0.20 | — | — |
| Perfume | 0.30 | 0.30 | 0.30 | 0.27 |
| Total | 100.00 | 100.00 | 100.00 | 100.00 |

[1]Savinase* 12.0 T
[2]Lipolase* 100 T
[3]Termamyl* 60 T
[4]Carezyme*

We claim:

1. A particulate laundry detergent composition having a bulk density within the range of from 550 to 900 g/l, comprising non-soap organic surfactants and detergency builders, the composition comprising at least two different granular multiingredient components:

(i) a first granular component comprising non-soap surfactant and detergency builder and having a bulk density within the range of from 550 to 1000 g/l, the first granular component having a weight ratio of a first ingredient to a second ingredient of r, (ii) a second granular component comprising non-soap surfactant and detergency builder and having a bulk density within the range of from 300 to 550 g/l and having a weight ratio of the first ingredient to the second ingredient of r', wherein the ratio of r to r' is within the range of from 1.25:1 to 1:1.25, and wherein the first ingredient is selected from the group consisting of non-soap anionic surfactant and total non-soap surfactant, and the second ingredient is non-ionic surfactant.

2. A detergent composition as claimed in claim 1, wherein the ratio of r to r' is within the range of from 1.2:1 to 1:1.2.

3. A detergent composition as claimed in claim 2, wherein the ratio of r to r' is within the range of from 1.1:1 to 1:1.1.

4. A detergent composition as claimed in claim 3, wherein the ratio of r to r' is within the range of from 1.05:1 to 1:1.05.

5. A detergent composition as claimed in claim 1, wherein the first granular component has a bulk density within the range of from 600 to 1000 g/l.

6. A detergent composition as claimed in claim 1, wherein the first granular component has a bulk density within the range of from 650 to 900 g/l.

7. A detergent composition as claimed in claim 1, wherein the first granular component is a mechanically mixed granule.

8. A detergent composition as claimed in claim 1, wherein the second granular component has a bulk density within the range of from 350 to 500 g/l.

9. A detergent composition as claimed in claim 1, wherein the second granular component is a spray-dried granule.

10. A detergent composition as claimed in claim 1, wherein the first ingredient is non-soap anionic surfactant.

11. A detergent composition as claimed in claim 1, wherein the non-soap anionic surfactants in the first and second granular components are same.

12. A detergent composition as claimed in claim 1, wherein the non-soap anionic surfactant is selected from the group consisting of $C_8$–$C_{15}$ alkylbenzene sulphonates, $C_8$–$C_{20}$ primary alcohol sulphates and combinations thereof.

13. A detergent composition as claimed in claim 1, wherein the nonionic surfactants in the first and second granular components are the same.

14. A detergent composition as claimed in claim 1, wherein the nonionic surfactant is a $C_8$–$C_{20}$ aliphatic alcohol ethoxylated with an average of from 2 to 15 moles of ethylene oxide per mole of alcohol.

15. A detergent composition as claimed in claim 1, wherein the detergency builders in the first and second granular components are the same.

16. A detergent composition as claimed in claim 15, wherein the detergency builder is an inorganic builder and is selected from the group consisting of alkali metal aluminosilicate, sodium tripolyphosphate, and combinations thereof.

17. A detergent composition as claimed in claim 1, wherein the first and second granular components are present in a weight ratio of from 0.1:1 to 5:1.

18. A detergent composition as claimed in claim 1, wherein the first and second granular components are present in a weight ratio of from 0.1:1 to 3:1.

19. A detergent composition as claimed in claim 1, wherein the first and second granular components are present in a weight ratio of from 0.1:1 to 2:1.

20. A detergent composition as claimed in claim 1, which comprises:

(i) from 8 to 60 wt %, of the first granular component, (ii) from 5 to 70 wt %, of the second granular component, (iii) optionally other admixed detergent ingredients to 100 wt %.

21. A detergent composition as claimed in claim 20 containing from 15–45% wt % of the first granular component.

22. A detergent composition as claimed in claim 20 containing from 10–60% wt % of the second granular component.

23. A detergent composition as claimed in claim 1, having a bulk density within the range of from 600 to 800 g/liter.

* * * * *